US006018158A

United States Patent [19]

Kang

[11] Patent Number: 6,018,158

[45] Date of Patent: Jan. 25, 2000

[54] MICROWAVE OVEN HAVING A VENTILATOR INSTALLED BESIDE A COOKING CHAMBER

[75] Inventor: Jeon Hong Kang, Kunpo, Rep. of Korea

[73] Assignee: Samsung Electronics Co., Ltd., Suwon, Rep. of Korea

[21] Appl. No.: 09/234,709

[22] Filed: Jan. 21, 1999

[30] Foreign Application Priority Data

Jun. 16, 1998 [KR] Rep. of Korea ..... 98-22612

[51] Int. Cl.[7] ..... H05B 6/80

[52] U.S. Cl. ..... 219/757; 219/681; 126/21 A; 126/299 D

[58] Field of Search ..... 219/757, 756, 219/681; 126/21 A, 299 D, 275 E, 273 A

[56] References Cited

U.S. PATENT DOCUMENTS 4,143,646 3/1979 Sampsel ..... 126/299 D
4,418,261 11/1983 Jailor et al. ..... 219/757
4,886,046 12/1989 Welch ..... 219/757
5,780,822 7/1998 Lee ..... 219/757
5,866,886 2/1999 Lange et al. ..... 219/757

*Primary Examiner*—Philip H. Leung
*Attorney, Agent, or Firm*—Burns, Doane, Swecker & Mathis, L.L.P.

[57] ABSTRACT

A microwave oven has an inner casing for forming a cooking chamber, and an outer casing for enclosing the inner casing. An air duct is formed between the inner casing and the outer casing. A drawing port and an exhaust port are formed respectively on the lower and the upper sides of the outer casing, and the air duct interconnects the ports. A ventilator is installed beside the cooking chamber in the air duct. The ventilator has an axial fan rotating about a vertical axis so as to draw air into the air duct through the suction port and exhaust air in the air duct through the exhaust port. The size of the cooking chamber is not reduced by the ventilator since the ventilator is installed beside the cooking chamber, and the drawing force of gas increases to thereby enhance the ventilation effect since the ventilator is disposed near the drawing port.

2 Claims, 6 Drawing Sheets

MICROWAVE OVEN HAVING A VENTILATOR INSTALLED BESIDE A COOKING CHAMBER

BACKGROUND OF THE INVENTION

1. Field of the Invention

The present invention relates to a microwave oven, and more particularly, to a microwave oven having a ventilator for ventilating indoor air.

2. Prior Art

A microwave oven is an appliance for cooking food by radiating microwaves onto a foodstuff accommodated in a cooking chamber, which is commonly used in a kitchen. Recently, a microwave oven serves both as a cooking appliance and as a ventilator for removing the gas generated by a gas range or a gas oven range, or the smell of a food. Such a microwave oven serving as a ventilator is generally installed over a cooking appliance such as a gas oven range, and therefore it is called an OTR (Over-the-Range).

FIG. 1 shows a kitchen in which a microwave oven serving as a ventilator is installed, and FIG. 2 is a rear perspective view of the microwave oven shown in FIG. 1. A gas oven range 20 is installed in the central part of a sink 10 in the kitchen. A cupboard 40 is mounted over the sink 10. An accommodation space is prepared in the central part of the cupboard 40, and the microwave oven 30 is accommodated in the accommodation space.

A suction grill 32 is installed on the upper front side of the microwave oven 30, and a suction port 31 is formed on the bottom side thereof. An exhaust port 36 is formed on the upper side of the microwave oven 30. As shown in FIG. 3, an air duct 38 is provided in the microwave oven 30. The air duct 38 is extended from the suction port 31 to the exhaust port 36. An accommodation part 37 is formed on the rear upper portion of the microwave oven 30, and a ventilator 35 is accommodated in the accommodation part 37.

The ventilator 35 is comprised of a driving motor 34 and a pair of crossflow fans 33 driven by the driving motor 34. An assembly member 39 is installed on the exhaust port 36. The assembly member 39 connects the microwave oven 30 to an exhaust pipe which is not shown in the figures.

As the ventilator 35 operates, the gas generated from the gas oven range 20 is drawn into the air duct 38 through the suction port 31 and the suction grill 32, and then is exhausted through the exhaust port 36. The exhausted gas is discharged out of the room through the exhaust pipe.

However, in such a conventional microwave oven 30, there is a problem that the size of the cooking chamber in the microwave oven 30 is reduced by the size of the accommodation part 37 for accommodating the ventilator 35. In particular, since the fan used in the ventilator 35 is a crossflow fan 33, the ventilator 35 should be disposed horizontally on the upper rear area of the microwave oven 30, and therefore, the size of the cooking chamber is inevitably reduced. If the capacity of the ventilator 35 is increased to enhance the efficiency of ventilation, the space of the cooking chamber has to be narrowed more.

Furthermore, since the ventilator 35 is far from the suction port 31 formed on the lower side of the microwave oven 30, the power of the crossflow fan 34 for drawing air through the suction port 31 is weak.

SUMMARY OF THE INVENTION

The present invention has been proposed to overcome the above-described problems in the prior art, and accordingly it is the object of the present invention to provide a microwave oven which can prevent the cooking chamber from being reduced by the ventilator, and reinforce the power for drawing gas.

To achieve the above object, the present invention provides a microwave oven comprising: an inner casing forming a cooking chamber; an outer casing enclosing the inner casing, and having a suction port formed on the lower side thereof and an exhaust port formed on the upper side thereof; an air duct formed beside the cooking chamber so as to interconnect the suction port and the exhaust port vertically, the air duct for providing a passage for air drawn through the suction port; and an axial fan installed in the air duct, the axial fan rotating about a vertical axis so as to draw air into the air duct through the suction port and exhaust air in the air duct through the exhaust port.

It is preferable that the air duct communicates with a machine chamber for accommodating a plurality of electrical devices. Then, the electrical devices in the machine chamber are cooled while the axial fan is rotating.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the accompanying drawings.

Figure 1:
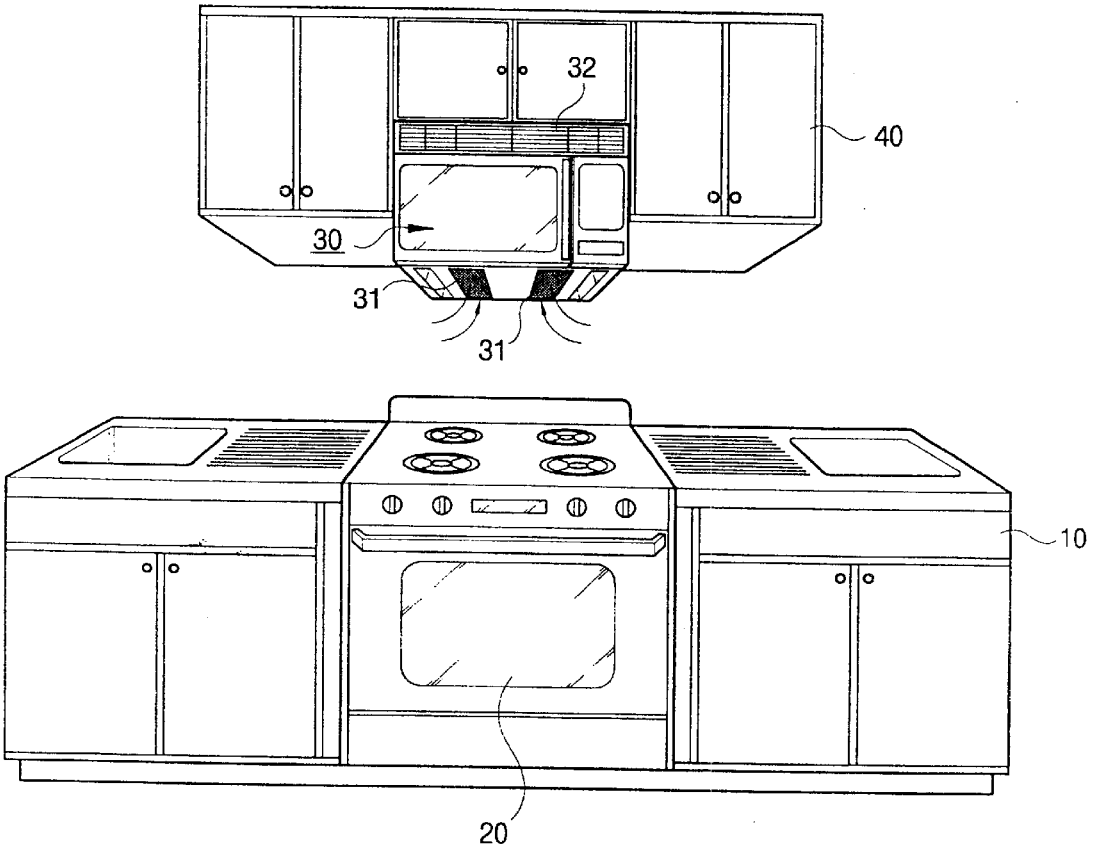
FIG. 1 (PRIOR ART)
FIG. 1 shows a kitchen with which a microwave oven serving as a ventilator is equipped.
Figure 2:
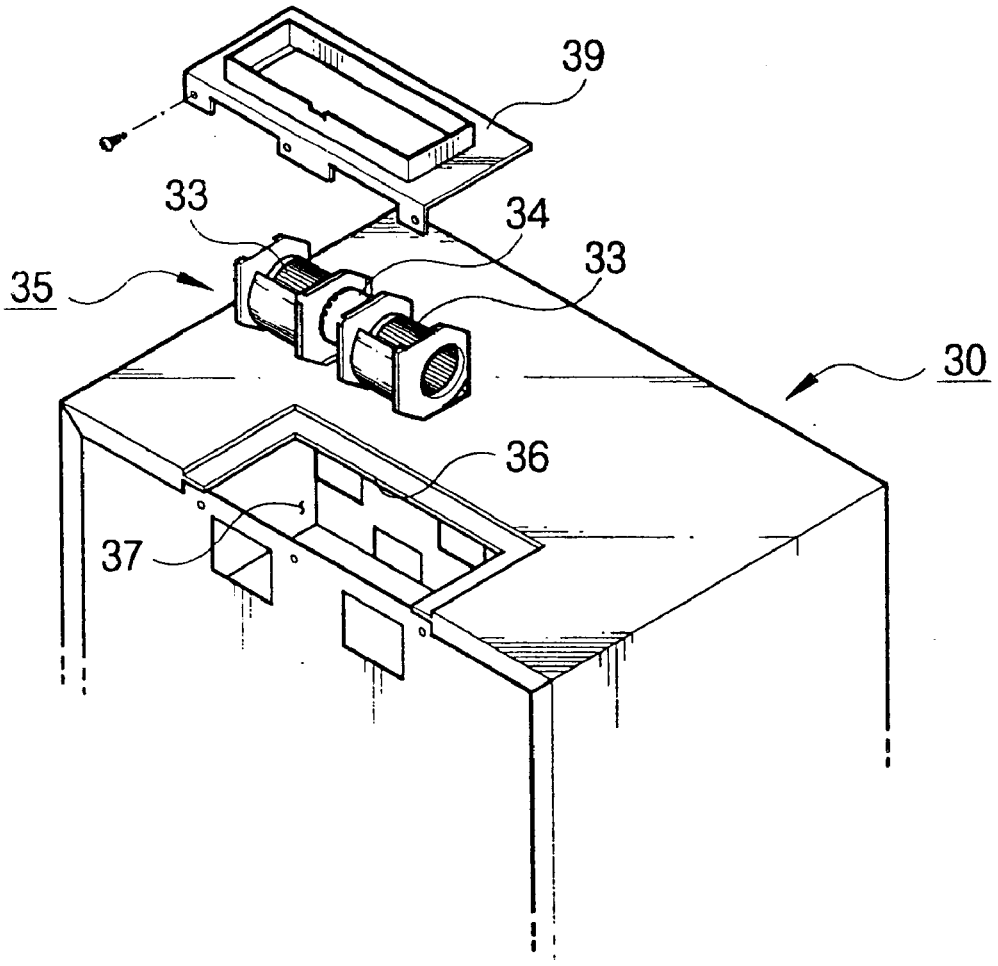
FIG. 2 (PRIOR ART)
FIG. 2 is a rear perspective view of the microwave oven shown in FIG. 1 showing the upper part thereof.
Figure 3:
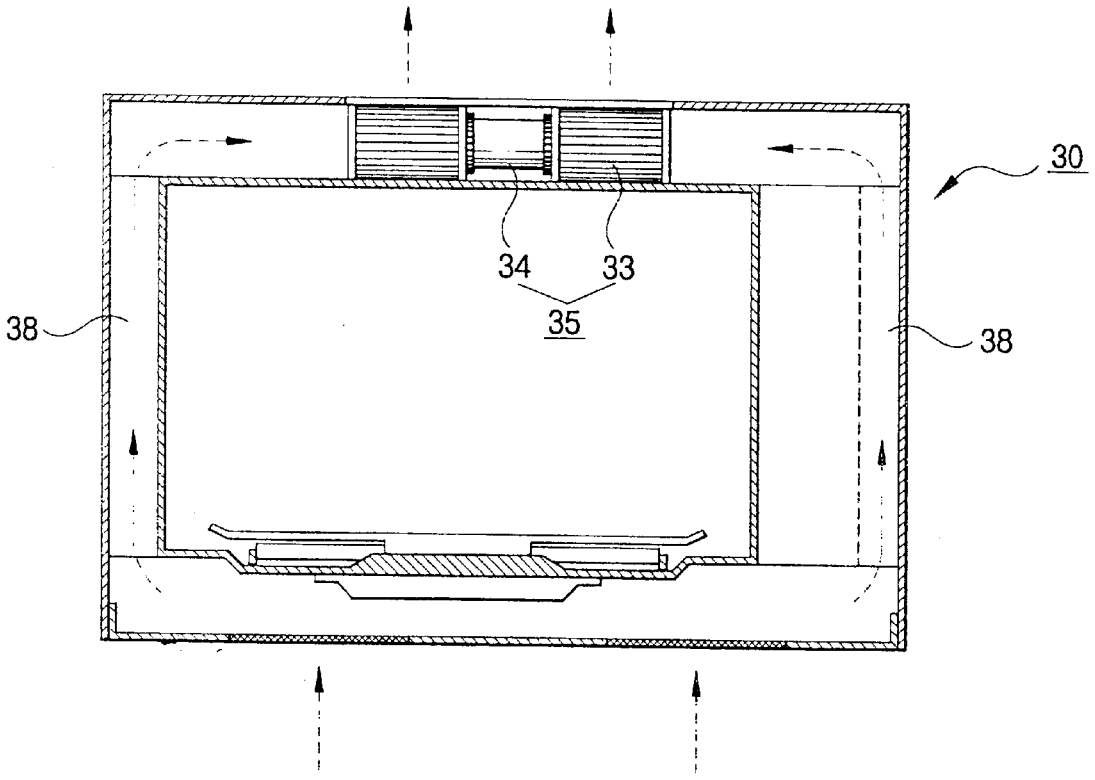
FIG. 3 (PRIOR ART)
FIG. 3 is a schematic sectional view of FIG. 2.
Figure 4:
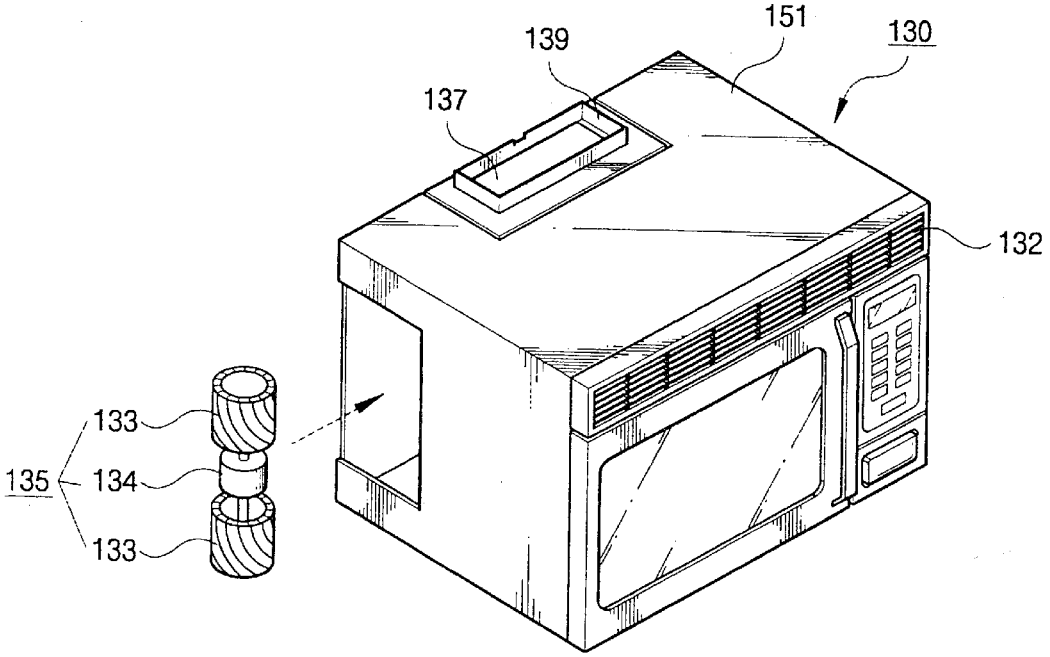
FIG. 4 is a perspective view of a microwave oven according to the present invention.
Figure 5:
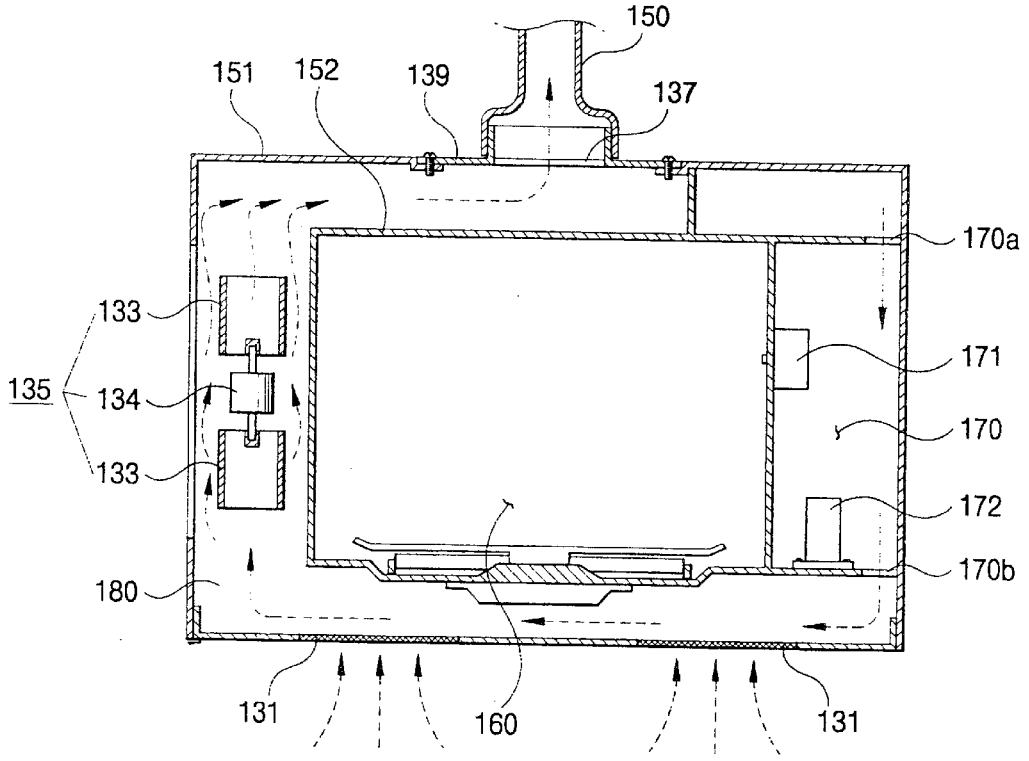
FIG. 5 is a sectional view of FIG. 4.

FIG. 4 is a perspective view of a microwave oven according to the present invention, and FIG. 5 is a sectional view of FIG. 4. Like the conventional microwave oven shown in FIG. 1, the microwave oven 130 according to the present invention is installed over the gas oven range, and functions to cook a foodstuff and to exhaust gas generated from the gas oven range toward an outside of a room.

The microwave oven 130 has an inner casing 152 forming a cooking chamber 160, and an outer casing 151 enclosing the outer side of the inner casing 152. A suction grill 132 is installed on the upper front side of the outer casing 151, and a suction port 131 is formed on the lower side thereof. An assembly member 139 having an exhaust port 137 is installed on the upper side of the outer casing 151. An exhaust pipe 150 is connected to the assembly member 139.

The space between the inner casing 152 and the outer casing 151 forms an air duct 180. The air duct 180 is formed through the side portion and the upper portion of the microwave oven 130, and provides a passage for air drawn through the suction port 131 to be guided toward the exhaust port 137.

On the left hand of the cooking chamber 160 in the air duct 180, a ventilator 135 is installed. The ventilator 135 is comprised of a driving motor 134, and a pair of axial fans 133 installed on the shaft of the driving motor 134 The shaft of the driving motor 134 is disposed vertically, and the axial fans 133 are installed respectively on the upper and the lower ends of the shaft. The axial fan 133 has, as shown in FIG. 4, spiral blades disposed spirally on the circumference of a cylinder around a vertical axis. Thus, as the axial fans 133 are rotated by the driving motor 134, the air in the air duct 180 is blown upward by the axial fans 133.

On the right hand of the cooking chamber 160, a machine chamber 170 is provided which accommodates electrical devices such as a magnetron 171 for generating microwaves and a High Voltage Transformer 172 for generating a high voltage supplied into the magnetron 171, etc. Ventilation holes 170*a* and 170*b* are formed respectively on the upper and the lower sides of the machine chamber 170. The suction grill 132 communicates with the machine chamber 170 through the upper ventilation hole 170*a*, and the machine chamber 170 communicates with the air duct 180 through the lower ventilation hole 170*b*. Therefore, the air drawn through the suction grill 132 is drawn into the machine chamber 170 through the upper ventilation hole 170*a*, and the air drawn into the machine chamber 170 is drawn into the air duct 180 through the lower ventilation hole 170*b*.

When a user operates the ventilator 135 in the microwave oven 130, the axial fans 133 are rotated by the driving motor 134. Then, the gas generated by the gas oven range 20 is drawn into the air duct 180 through the suction port 131 and the suction grill 132. The gas drawn through the suction port 131 is moved up along the air duct 180, and then is discharged into the exhaust pipe 150 through the exhaust port 137. The gas drawn through the suction grill 132 is drawn into the air duct 180 via the machine chamber 170, and then is discharged into the exhaust pipe 150 through the exhaust port 137. The gas discharged into the exhaust pipe 150 is exhausted out through the exhaust pipe 150.

Since the ventilator 135 is disposed beside the cooking chamber 160, the inner space of the cooking chamber 160 is not narrowed by the ventilator 135. Further, since the ventilator 135 is disposed near the suction port 131, the power for drawing the gas increases to thereby enhance the ventilating efficiency. Moreover, the machine chamber 170 is cooled during the ventilating operation.

Figure 6:
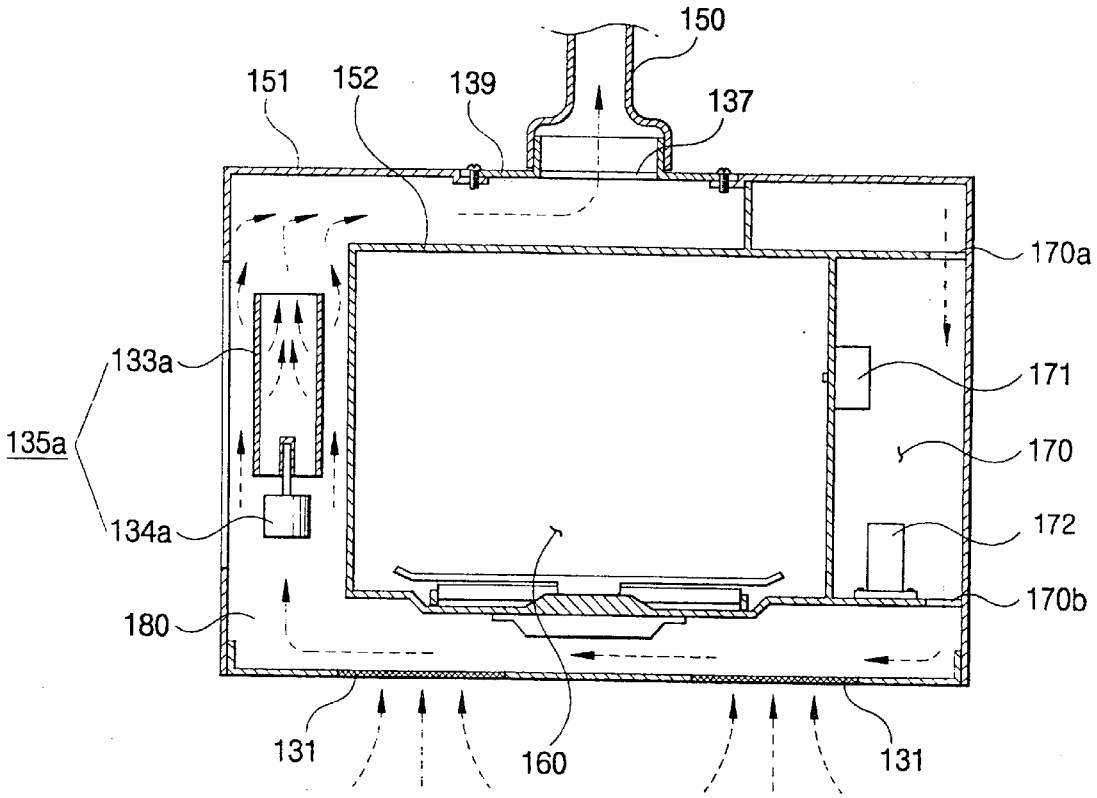
FIG. 6 is another embodiment of the present invention.

FIG. 6 shows another embodiment of the present invention. In the present embodiment, other parts than the ventilator 135*a* comprised of a driving motor 134*a* and a single axial fan 133*a* are the same in construction as the above-described embodiment. This embodiment also shows the same operation and effect as the prior embodiment.

As described above, according to the present invention, the size of the cooking chamber 170 is not reduced by a ventilator 135, and the ventilation is performed more effectively.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A microwave oven comprising:

a casing arrangement including:

an inner casing forming a cooking chamber, and an outer casing enclosing the inner casing, the outer casing having a suction port formed in a lower side thereof and an exhaust port formed in an upper side thereof, the casing arrangement forming a machine chamber disposed between the inner and outer casings, the machine chamber containing a microwave generating mechanism;

an air duct formed between the inner casing and the outer casing and interconnecting the suction port and the exhaust port, the air duct providing a passage for guiding air drawn through the suction port to the exhaust port, the air duct including a vertically extending portion disposed beside and outside of the cooking chamber at a location spaced from the machine chamber, the vertically extending portion extending from a bottom of the cooking chamber to a top of the cooking chamber; and an axial fan installed in the vertically extending portion of the air duct, the axial fan having blades disposed helically around a vertical axis, and the axial fan rotating about the vertical axis so as to draw air into the air duct through the first suction port and exhaust air from the air duct through the exhaust port.

2. A microwave oven comprising:

a casing arrangement including:

an inner casing forming a cooking chamber, and an outer casing enclosing the inner casing, the outer casing having a first suction port formed in a lower side thereof and an exhaust port formed in an upper side thereof, the casing arrangement forming a machine chamber disposed between the inner and outer casings, the machine chamber containing a microwave generating mechanism, and including an upper ventilation hole and a lower ventilation hole;

a second suction port disposed in the outer casing near the upper side thereof, the second suction port communicating with the upper ventilation hole of the machine chamber;

an air duct formed between the inner casing and the outer casing and interconnecting the suction port and the exhaust port, the air duct providing a passage for guiding air drawn through the suction port to the exhaust port, the air duct communicating with the lower ventilation hole of the machine chamber for guiding air from the lower ventilation hole to the exhaust port, the air duct including a vertically extending portion disposed beside and outside of the cooking chamber at a location spaced from the machine chamber, the vertically extending portion extending from a bottom of the cooking chamber to a top of the cooking chamber; and an axial fan installed in the vertically extending portion of the air duct, the axial fan having blades disposed helically around a vertical axis, and the axial fan rotating about the vertical axis so as to draw air into the air duct through the first suction port and exhaust air from the air duct through the exhaust port, and to draw air into the machine chamber through the second suction port and the upper ventilation hole and exhaust that air through the air duct and the exhaust port.

* * * * *